US006425798B1

(12) United States Patent
Uhlenkamp

(10) Patent No.: US 6,425,798 B1
(45) Date of Patent: Jul. 30, 2002

(54) WHEEL TOY

(76) Inventor: Robert H. Uhlenkamp, 312 N. 2nd St., Sauk Centre, MN (US) 56378

( * ) Notice: Subject to any disclaimer, the term of this patent is extended or adjusted under 35 U.S.C. 154(b) by 0 days.

(21) Appl. No.: 09/648,238

(22) Filed: Aug. 25, 2000

(51) Int. Cl.[7] ..... A63H 33/02

(52) U.S. Cl. ..... 446/452; 446/450; 446/411; 446/412; 446/448; 446/246

(58) Field of Search ..... 446/450, 451, 446/452, 453, 457, 411, 412, 228, 490, 431, 441, 448, 96, 465, 236, 246; D21/419, 421, 465; 119/701, 702, 707, 708

(56) References Cited

U.S. PATENT DOCUMENTS

| | | | | | |
|---|---|---|---|---|---|
| 418,885 | A | * | 1/1890 | Martineau | 446/452 |
| 602,258 | A | | 4/1898 | Haupt | |
| 889,674 | A | * | 6/1908 | Fraser | 446/452 |
| 1,021,554 | A | * | 3/1912 | Plummer | 446/453 |
| 1,499,216 | A | | 6/1924 | Hart | |
| 2,307,905 | A | * | 1/1943 | Ament | 119/708 |
| 2,469,449 | A | * | 5/1949 | Baskin | 446/228 |
| 2,712,712 | A | * | 7/1955 | Hajek et al. | 446/452 |
| 2,846,225 | A | | 8/1958 | Keyser | |
| 3,389,494 | A | * | 6/1968 | Blau | 446/452 |
| 3,942,797 | A | * | 3/1976 | Shankel et al. | 446/490 |
| 4,070,791 | A | | 1/1978 | Dill | |
| D262,468 | S | | 12/1981 | Jackson | |
| 6,142,850 | A | * | 11/2000 | Levy | 446/248 |

* cited by examiner

*Primary Examiner*—Jacob K. Ackun
*Assistant Examiner*—Faye Francis

(57) ABSTRACT

A wheel toy for entertaining and providing physical exercise. The wheel toy includes a wheel. A rod, which is elongate and has a first end and a second end, is extendable into and securely attached to an axis of the wheel.

1 Claim, 2 Drawing Sheets

WHEEL TOY

BACKGROUND OF THE INVENTION

1. Field of the Invention

The present invention relates to toy devices and more particularly pertains to a new wheel toy for entertaining and providing physical exercise.

2. Description of the Prior Art

The use of toy devices is known in the prior art. More specifically, toy devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 1,499,216; U.S. Pat. No. 602,258; U.S. Pat. No. 2,846,225; U.S. Pat. No. 4,070,791; and U.S. Des. Pat. No. 262,468.

While these devices fulfill their respective, particular objectives and requirements, the aforementioned patents do not disclose a new wheel toy. The inventive device includes a wheel. A rod, which is elongate and has a first end and a second end, is extendable into and securely attached to an axis of the wheel.

In these respects, the wheel toy according to the present invention substantially departs from the conventional concepts and designs of the prior art, and in so doing provides an apparatus primarily developed for the purpose of entertaining and providing physical exercise.

SUMMARY OF THE INVENTION

In view of the foregoing disadvantages inherent in the known types of toy devices now present in the prior art, the present invention provides a new wheel toy construction wherein the same can be utilized for entertaining and providing physical exercise.

The general purpose of the present invention, which will be described subsequently in greater detail, is to provide a new wheel toy apparatus and method which has many of the advantages of the toy devices mentioned heretofore and many novel features that result in a new wheel toy which is not anticipated, rendered obvious, suggested, or even implied by any of the prior art toy devices, either alone or in any combination thereof.

To attain this, the present invention generally comprises a wheel. A rod, which is elongate and has a first end and a second end, is extendable into and securely attached to an axis of the wheel.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new wheel toy apparatus and method which has many of the advantages of the toy devices mentioned heretofore and many novel features that result in a new wheel toy which is not anticipated, rendered obvious, suggested, or even implied by any of the prior art toy devices, either alone or in any combination thereof.

It is another object of the present invention to provide a new wheel toy which may be easily and efficiently manufactured and marketed.

It is a further object of the present invention to provide a new wheel toy which is of a durable and reliable construction.

An even further object of the present invention is to provide a new wheel toy which is susceptible of a low cost of manufacture with regard to both materials and labor, and which accordingly is then susceptible of low prices of sale to the consuming public, thereby making such wheel toy economically available to the buying public.

Still yet another object of the present invention is to provide a new wheel toy which provides in the apparatuses and methods of the prior art some of the advantages thereof, while simultaneously overcoming some of the disadvantages normally associated therewith.

Still another object of the present invention is to provide a new wheel toy for entertaining and providing physical exercise.

Yet another object of the present invention is to provide a new wheel toy which includes a wheel. A rod, which is elongate and has a first end and a second end, is extendable into and securely attached to an axis of the wheel.

Still yet another object of the present invention is to provide a new wheel toy that provides exercise and improves hand-eye coordination.

Even still another object of the present invention is to provide a new wheel toy that provides interaction with other toy items for additional entertainment possibilities.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
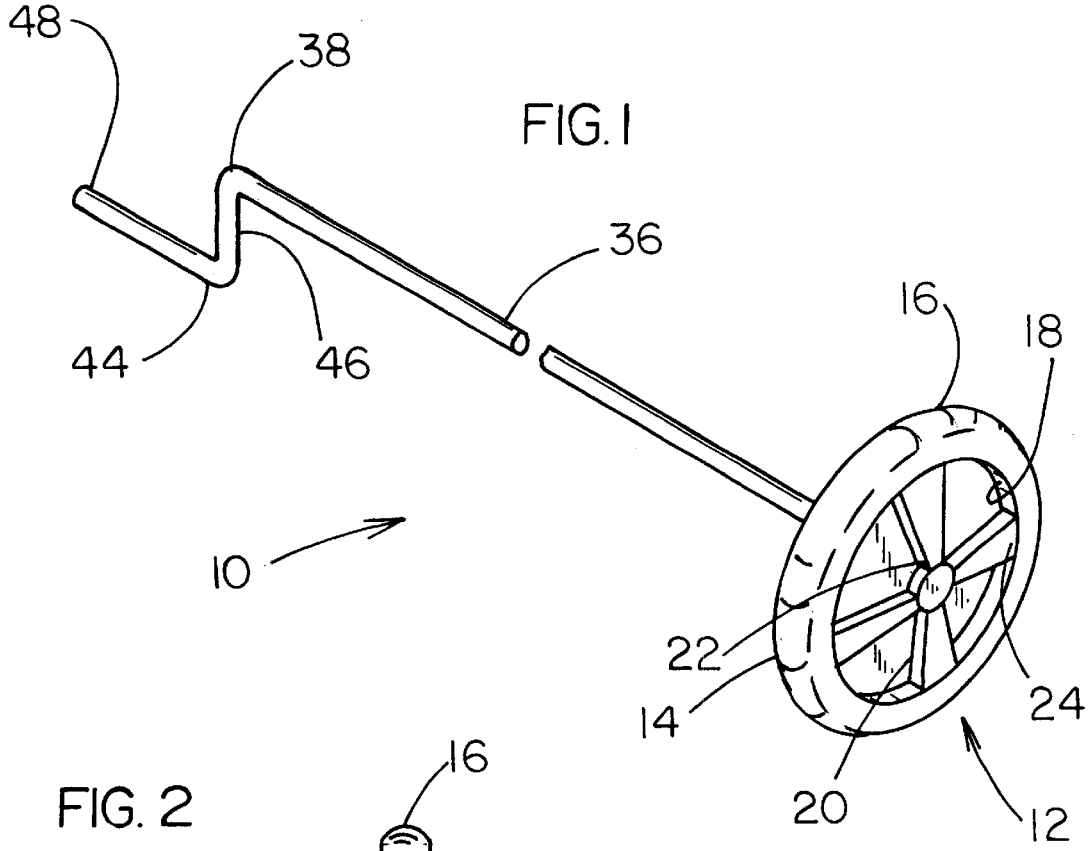
FIG. 1 is a schematic perspective view of a new wheel toy according to the present invention.
Figure 2:
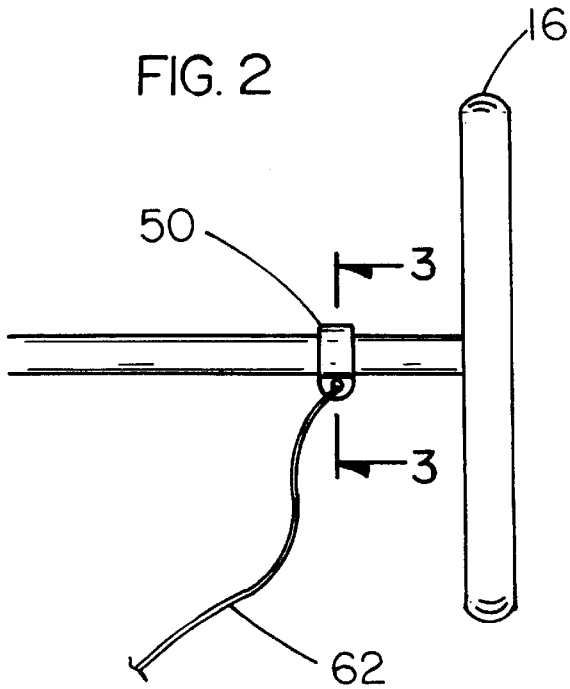
FIG. 2 is a schematic side view of the present invention.
Figure 3:
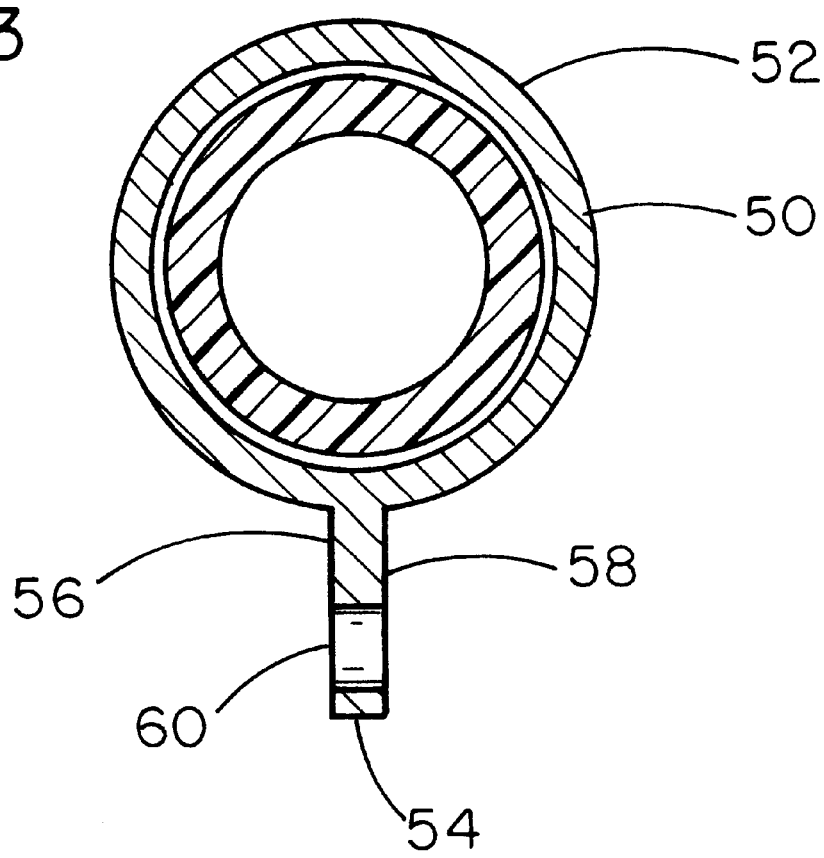
FIG. 3 is a schematic cross-sectional view taken along line 3—3 of the present invention.
Figure 4:
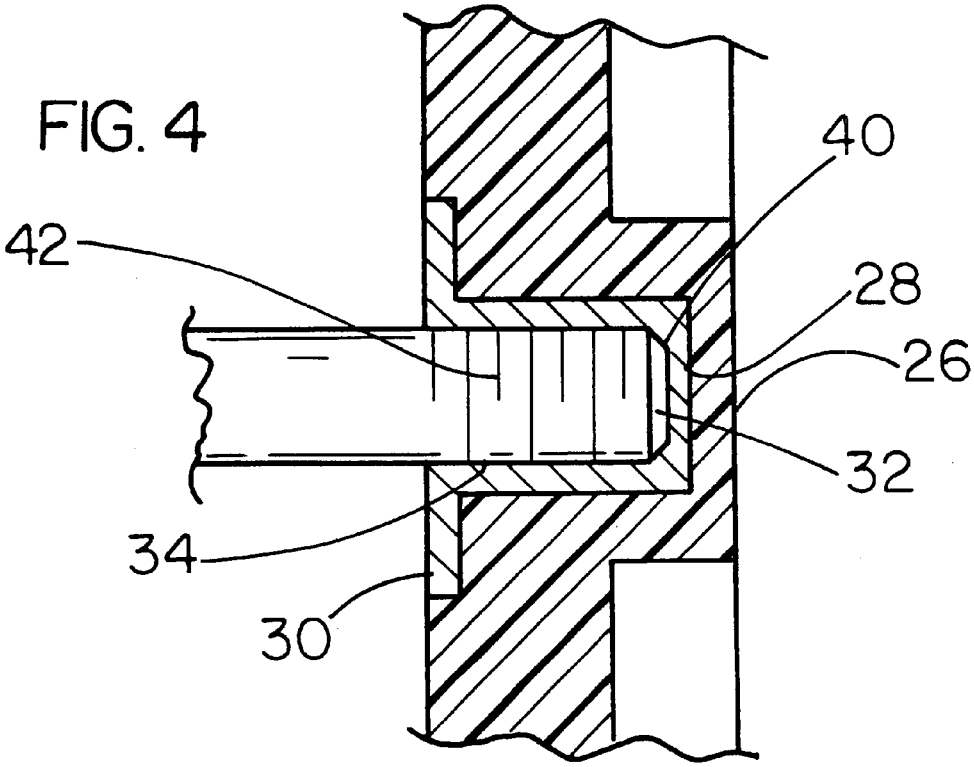
FIG. 4 is a schematic cross-sectional view of the rod and axis of the wheel of the present invention.

With reference now to the drawings, and in particular to FIGS. 1 through 4 thereof, a new wheel toy embodying the principles and concepts of the present invention and generally designated by the reference numeral 10 will be described.

As best illustrated in FIGS. 1 through 4, the wheel toy 10 generally comprises a wheel 12. The wheel 12 includes an annular member 14 and a plurality of spokes 20.

The annular member 14 has an inner surface 16 and an outer surface 18. The outer surface 18 is generally convex. The annular member 14 has a diameter preferably between ½ feet and 2 feet.

Each of the plurality of spokes 20 has a first end 22 and a second end 24. Each of the first ends 24 is integrally coupled together and radially extends from an axis 26. The spokes 20 each substantially lie in a plane. The second ends 24 are securely attached to the inner surface 18 of the annular member 26. Preferably, the space between the spokes is filled in as is depicted in FIG. 1. The axis 26 has a bore 28 therein. A sleeve 30 is positioned in the bore 28 and securely attached to the first ends 22 of the spokes 20. The sleeve 30 has a hole 32 therein. The hole 32 has an annular side wall 34. The annular side wall 34 is threaded, and the sleeve 30 ideally comprises a metal.

A rod 36, is elongate, and has a first end 38 and a second end 40. The second end 40 of the rod 36 is extendable into the hole 32. The rod 36 has threads 42 thereon located substantially adjacent to the second end 40 such that the threads on the rod 36 may removably couple to the threads in the annular side wall 34. The rod 36 has a length preferably between 3 feet and 4 feet, and ideally the rod 36 has a length equal to 3½ feet.

A turning means turns the rod. The turning means comprises a crank 44 having a leg portion 46 and a foot portion 48. The leg 46 portion is orientated generally perpendicular to the foot portion 48 such that the crank 44 generally has an L-shape. A free end of the leg portion 46 is integrally coupled to the first end 38 of the rod 36. The leg portion 46 is orientated generally perpendicular to a longitudinal axis of the rod 36.

A ring member 50 is rotatably coupled to the rod 36 such that the rod 36 extends through a central portion of the ring member 50. The ring member 50 has an exterior surface 52. A protruding member 54 is integrally attached to and extends away from the exterior surface 52. The protruding member 54 has a generally planar front 56 and back side 58. The front 56 and back 58 sides lie in planes orientated generally parallel to the longitudinal axis of the rod 36. The protruding member 54 has an opening 60 therethrough. The opening 60 extends through the front 56 and back 58 sides of the protruding member 54.

In use, the user turns the crank 46 such that the wheel 12 is rotatably moved across a surface. A string 62, cord, or the like may be positioned through the opening 60 in protruding member 54 and attached thereto such that a toy or other item may be coupled to a free end of the string 62. The as the wheel is turned the ring member 50 rotates so that the string does not wrap about the rod 36.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheel toy comprising:

a wheel including;

an annular member having an inner surface and an outer surface, said outer surface being generally convex, said annular member having a diameter generally between ½ feet and 2 feet;

a plurality of spokes, each of said plurality of spokes having a first end and a second end, each of said first ends being integrally coupled together and radially extending from an axis, each of said spokes substantially lying in a plane, each of said second ends being securely attached to said inner surface of said annular member, said axis having a bore therein, a sleeve being positioned in said bore and securely attached to said first ends of said spokes, said sleeve having a hole therein, said hole having an annular side wall, said annular side wall being threaded, said sleeve comprising a metal;

an elongate rod having a first end and a second end, said rod having threads thereon located adjacent to said second end for coupling said second end to said threads in said annular side wall, said rod having a length generally between 3 feet and 4 feet;

a turning means for turning said rod, said turning means comprising a crank, said crank having a leg portion and a foot portion, said leg portion being orientated generally perpendicular to said foot portion, a free end of said leg portion being integrally coupled to said first end of said rod, said leg portion being orientated generally perpendicular to a longitudinal axis of said rod; and a ring member being rotatably coupled to said rod such that said rod extends through a central portion of said ring member, said ring member having an exterior surface, a protruding member being integrally attached to and extending away from said exterior surface, said protruding member having a generally planar front and back side, said front and back sides lying in planes orientated generally parallel to said longitudinal axis of said rod, said protruding member having an opening therethrough, said opening extending through said front and back sides of said protruding member.

* * * * *